US005906524A

United States Patent [19]

Ozawa et al.

[11] Patent Number: 5,906,524

[45] Date of Patent: May 25, 1999

[54] THROTTLE POSITION SENSOR MOUNTING ARRANGEMENT FOR PERSONAL WATERCRAFT ENGINE

[75] Inventors: Sigeyuki Ozawa; Ryoichi Nakase, both of Iwata, Japan

[73] Assignee: Yamaha Hatsudoki Kabushiki Kaisha, Iwata, Japan

[21] Appl. No.: 08/999,418

[22] Filed: Dec. 29, 1997

[30] Foreign Application Priority Data

Dec. 28, 1996 [JP] Japan ..... 8-359050

[51] Int. Cl.[6] ..... B63H 21/10

[52] U.S. Cl. ..... 440/88; 440/1

[58] Field of Search ..... 440/1, 2, 77, 88, 440/89; 114/270; 123/198 DC, 198 D, 195 P

[56] References Cited

U.S. PATENT DOCUMENTS 5,445,121 8/1995 Kai .
5,553,579 9/1996 Yoshida et al. .
5,558,549 9/1996 Nakase et al. ..... 440/88
5,606,952 3/1997 Kanno et al. .
5,655,500 8/1997 Kato .
5,704,334 1/1998 Kato .
5,846,102 12/1998 Nitta et al. ..... 440/88

*Primary Examiner*—Stephen Avila
*Attorney, Agent, or Firm*—Knobbe, Martens, Olson & Bear LLP

[57] ABSTRACT

A mounting arrangement for a throttle position sensor associated with a throttle valve is disclosed. The throttle valve is positioned within an intake pipe of an intake system of an engine which is positioned in an engine compartment defined by a hull of a watercraft. An output shaft of the engine is arranged to drive a water propulsion device of the watercraft. The intake pipe extends from the engine and is arranged to route air to a combustion chamber of the engine. The throttle position sensor is mounted so as to be shielded by the intake pipe from heat generated by the engine and radiated therefrom and from an exhaust system associated therewith.

10 Claims, 2 Drawing Sheets

THROTTLE POSITION SENSOR MOUNTING ARRANGEMENT FOR PERSONAL WATERCRAFT ENGINE

FIELD OF THE INVENTION

The present invention relates to a throttle position sensor, and more particularly to a mounting arrangement for such a sensor used with an engine powering a watercraft.

BACKGROUND OF THE INVENTION

Watercraft such as those known as "personal watercraft" have a hull which defines an engine compartment, and include a water propulsion device. An internal combustion engine is positioned in the engine compartment. An output shaft of the engine is arranged to drive the water propulsion device.

The engine has an intake system which draws air from within the engine compartment and delivers it to the combustion chamber(s) thereof. The watercraft includes one or more air passages leading from a point external to the hull through the hull into the engine compartment.

In addition, the watercraft includes a fuel system for supplying fuel to each combustion chamber of the engine. The fuel system includes a fuel tank positioned in the hull of the watercraft and a fuel pump delivering fuel from the tank to at least one charge former which introduces fuel to the engine.

A throttle control may be provided in the intake system of the engine for controlling the rate of air flow therethrough. In order to accurately control the rate of fuel delivery to the engine, the rate of air flow is measured. This may be accomplished indirectly with a throttle control sensor.

This type of sensor is electronically operated and sensitive to high heat conditions. Because the size of the engine compartment is limited, the engine is arranged to be compact, and as a result, the sensor is even more susceptible to overheating problems than in many other applications.

A watercraft powered by an engine and having a throttle position sensor arranged to overcome the above-stated problems is desired.

SUMMARY OF THE INVENTION

In accordance with the present invention there is provided a mounting arrangement for a throttle position sensor associated with an internal combustion engine powering a water propulsion device of a watercraft.

The watercraft has a water propulsion device and a hull defining an engine compartment, an internal combustion engine positioned in the engine compartment. The engine has an output shaft arranged to power the water propulsion device.

The engine has an intake system through which air is supplied to each combustion chamber of the engine. The intake system includes an intake pipe. A throttle valve is positioned in a passage through the intake pipe for controlling the rate of air flow therethrough.

The throttle position sensor is provided for monitoring the position of the throttle valve, and is mounted so as to be shielded by the intake pipe from heat generated by the engine and radiated thereby and by an exhaust pipe associated with the engine.

In the preferred embodiment, the engine is arranged to be compact, with the cylinders tilted into an axis which is offset from vertical towards a first side of the engine. In this arrangement, the intake pipe extends from a second side of the engine opposite the first. An exhaust pipe extends between the main body of the engine and the intake pipe. The sensor is positioned at a bottom side of the throttle body opposite the engine and exhaust pipe, and thus protected from heat.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
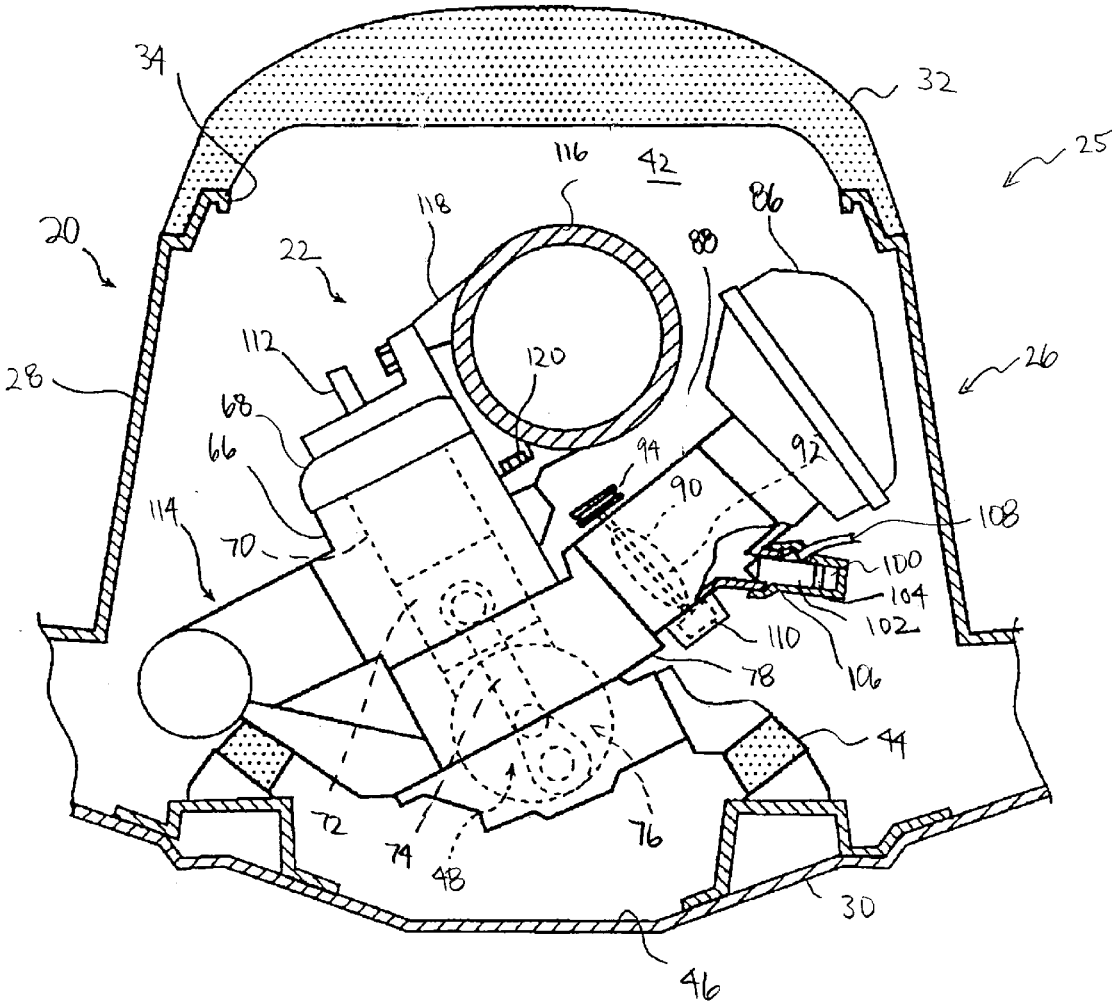
FIG. 1 is a cross-sectional end view of a watercraft powered by an engine having a throttle position sensor mounted in accordance with the present invention.
Figure 2:
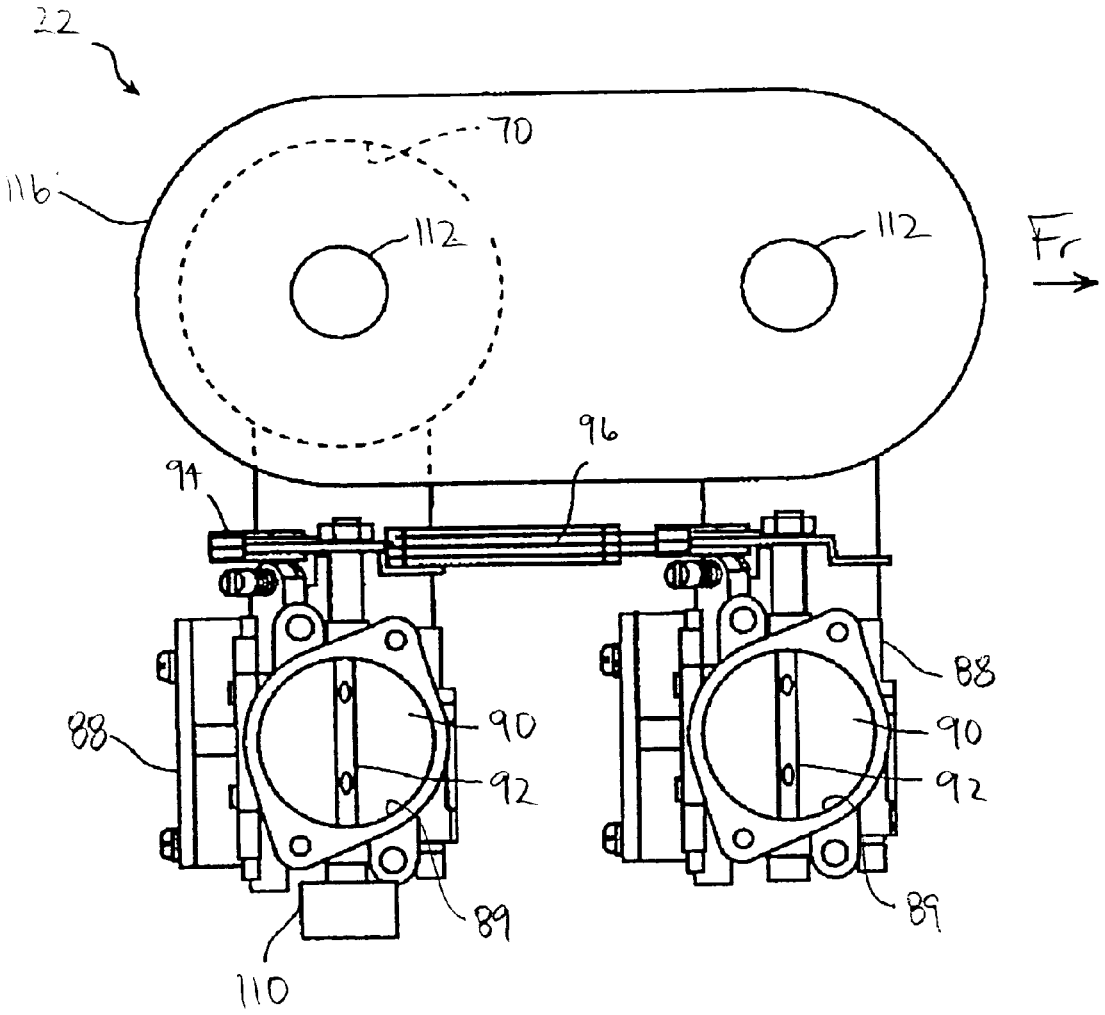
FIG. 2 is a top view of a portion of the engine having the throttle position sensor illustrated in FIG. 1 with an intake silencer of the engine removed.

FIGS. 1 and 2 illustrate a watercraft 20 having a mounting arrangement for a throttle position sensor in accordance with a first embodiment of the present invention. Referring first to FIG. 1, the watercraft 20 generally comprises a watercraft body 25 having the engine 22 mounted therein for powering a water propulsion device. The watercraft body 25 preferably comprises a hull 26 having a top portion or deck 28 and a lower portion 30. A gunnel (not shown) defines the intersection of the deck 28 and lower portion 30.

In addition, the body 25 includes a seat 32 positioned on the top portion 28 of the hull 26. The seat 32 is removably positioned over an access opening 34 which provides access to the engine 22 positioned therebelow. A steering handle (not shown) is provided adjacent the seat 32 for use by a user in directing the watercraft 20 in a manner described in more detail below. A throttle control grip (not shown) may be provided at the steering handle for use by the operator in controlling the position of a throttle, as described in more detail below.

The top and bottom portions 28,30 of the hull 26 cooperate to define an engine compartment 42. The engine 22 is positioned in the engine compartment 42. The engine 22 is connected to the hull 26 via several engine mounts 44 connected to a bottom 46 of the lower portion 30 of the hull 26.

The engine 22 has a crankshaft 48 arranged to drive a water propulsion device (not shown) of the watercraft 20. The water propulsion device may be of a wide variety of propulsion devices known to those of skill in the art. Preferably, the propulsion device comprises a propulsion passage having an impeller mounted therein and arranged to propel water through the passage out an outlet positioned at the rear of the watercraft 20. In this arrangement, the crankshaft 48 of the engine 22 is arranged to drive an impeller shaft on which the impeller is mounted.

As well known to those of skill in the art, in this type of arrangement, a nozzle (not shown) is movably positioned at the outlet of the propulsion passage for directing water which is forced through the outlet. The nozzle is connected to the steering handle, whereby the operator of the craft 20 may direct the craft in different directions by directing the propelled water with the nozzle by turning the steering handle.

The engine 22 will be described with reference to both FIGS. 1 and 2. As illustrated therein, the engine 22 is preferably of the two-cylinder variety, arranged in in-line fashion and operating on a two-cycle principle. Of course, the engine 22 may have as few as one, or more than two, cylinders, as may be appreciated by one skilled in the art.

The engine 22 includes a cylinder block 66 having a cylinder head 68 connected thereto and cooperating therewith to define two cylinders 70. A piston 72 is movably mounted in each cylinder 70 and connected to the crankshaft 48 via a connecting rod 74.

The crankshaft 62 is rotatably journalled with respect to the cylinder block 66 within a crankcase chamber 76. Preferably, the chamber 76 is defined by a crankcase cover member 78 which is connected to an end of the cylinder block 66 opposite the cylinder head 68.

In the embodiment illustrated, the engine 22 is arranged so that the crankshaft 48 extends generally parallel to a longitudinal axis through the watercraft 20 from a front end (in the direction Fr in FIG. 2) to a stern of the watercraft 20 opposite the front end.

The engine 22 includes means for providing an air and fuel mixture to each cylinder 70 for combustion therein. Air is drawn in to the engine compartment 42 through one or more intake ducts (not shown) leading through the hull 26.

Air within the engine compartment 42 is drawn through a filtered intake 86. The air passes from the intake 86 into an intake pipe. Preferably, the intake pipe comprises a throttle body 88 corresponding to each cylinder 70. Thus, in the illustrated embodiment, there are two throttle bodies 88 spaced from one another in a longitudinal direction along the length of the watercraft (see FIG. 2).

As best illustrated in FIG. 1, so that the engine 22 has a compact arrangement and so that its total height is reduced (so that the overall height of the watercraft 20 may be less and the center of gravity of the watercraft is low), the engine 22 is arranged so that the cylinders 70 extend along an axis which is offset from vertical. As illustrated, the cylinders 70 are in a plane which tilt towards one side of the watercraft 20.

In this arrangement, the engine 20 has one side which faces generally towards the bottom 46 of the hull 26 (i.e. the side towards which the cylinders 70 lean) and a side which faces upwardly slightly towards the access opening 34. The intake pipes are mounted so as to extend outwardly from the upwardly facing side of the engine 22, as best illustrated in FIG. 1.

A throttle valve 90 is movably positioned in a passage 89 through each throttle body 88 for controlling the rate of air flow therethrough. Each throttle valve 90 is preferably actuated by the operator of the watercraft 20 by the throttle control positioned on the steering handle. Each throttle valves 90 is mounted to a control rod or shaft 92. As illustrated, each shaft 92 preferably extends in a direction generally transverse or perpendicular to the crankshaft 48 (i.e. in a direction which corresponds to a side-to-side direction of the watercraft 20) and in a plane which is nearly parallel to the plane in which the cylinders 70 extend (i.e. offset from vertical).

Means are provided for moving the valves 90 in tandem. As illustrated, a throttle control cable 94 is connected to an end of one of the shafts 92. In the preferred embodiment, the cable 94 is connected to the shaft 92 corresponding to the throttle valve 90 which is closest the rear of the watercraft 20. The cable 94 is connected to that end of the shaft 92 which is closest the engine 22, as best illustrated in FIG. 1.

A connector 96 extends between the shafts 92, whereby movement of the first shaft which is directly connected to the cable 94 is transmitted to the second shaft 92. In this manner, the operator controls the movement of both valves 90 together.

The passage 89 through each throttle body 88 leads to an intake port (not shown) provided in the engine 22 leading to the crankcase chamber 76. The crankcase chamber 76 is divided into two compartments, a compartment corresponding to each cylinder 70. A reed-type valve (not shown) is positioned in each intake port. Each reed valve is arranged to permit the flow of air into the crankcase 76 but prevent the flow of air out of the crankcase 76 in the direction of the throttle body 88.

As is well known in the two-cycle engine art, the engine is arranged so that when the piston 72 moves upwardly, air is drawn through the intake system, including the reed valve into the crankcase chamber 76. As the piston 72 moves downwardly, the air is compressed and eventually flows through one or more scavenge passages (not shown) leading into the portion of the cylinder 70 above the piston 72.

Preferably, fuel is provided to each cylinder 70 for combustion with the air. The fuel system preferably includes a fuel supply comprising fuel positioned in a fuel tank which may be positioned in the hull 26 of the watercraft 20.

A fuel pump (not shown) or other delivery mechanism is provided for delivering fuel from the tank through a delivery line to a fuel rail 100 (see FIG. 1). The fuel pump preferably delivers fuel at high pressure to the fuel rail 100. A fuel injector 102 corresponding to each cylinder 70 receives fuel from the fuel rail 100.

Referring to FIG. 1, a connecting part 104 extends between the fuel rail 122 and the fuel injector 102 through which fuel is delivered. A protective cover 106 is provided at each coupling of the fuel rail 100 and fuel injector 102 for protecting them and the connecting part 104 from exposure to water and other harmful elements. The cover 106 may comprise a rubber sleeve or the like.

Each fuel injector 102 is arranged to inject fuel into the air passing through the passage 89 through the throttle body 88. Fuel which is supplied to the fuel rail under pressure but not delivered by the injectors 102 is preferably routed back to the fuel tank through a fuel return line (not shown).

The fuel injectors 102 are preferably of the solenoid-operated type, having a control wire 108 leading thereto and through which an electric control signal is transmitted for opening and closing a valve associated with the injector 102. The wire 108 is preferably also covered by the cover element 106 for protecting it from damage.

The timing of the control signal to each injector 124 is preferably provided by an electronic control unit (ECU) (not shown). The ECU receives data such as throttle valve position sensor 110 (described below) for use in controlling the timing of the fuel injection with each fuel injector 102.

An ignition system is provided for igniting the fuel and air charge which is supplied to the cylinder 70. The ignition system may be arranged in a variety of manners known to those of skill in the art. In general, the ignition system includes a power source, such as a battery or generator (not shown) and a spark plug 112 associated with each cylinder 70. The ECU is preferably arranged to selectively control the firing of each spark plug 112 in a timed manner for initiating combustion in each cylinder 70.

Exhaust generated by the engine 22 as a result of the combustion process is routed from the engine to a point external to the watercraft 20 by an exhaust system which includes exhaust piping. Preferably, a manifold 114 is connected to the side of the engine 22 opposite the intake pipe, and is thus located close to the bottom 46 of the hull 26. The manifold 114 has first and second passages each of which correspond to a passage (not shown) leading through the cylinder block 66 from each cylinder 70. An exhaust timing valve (not shown) may be provided in the passage leading through the cylinder block for controlling the timing of the opening and closing of the passage, as is well known to those of skill in the art.

As best illustrated in FIG. 1, the manifold 114 extends towards a front end of the engine 22, before looping back to an expanded portion 116 which extends along a top of the engine towards the rear of the watercraft 20. The expanded portion 116 is preferably connected to the engine 22 with one or more brackets 118 with bolts 120 or similar fasteners. A catalyst (not shown) is preferably positioned in this expanded portion of the manifold 114.

The manifold 114 leads to a water lock (not shown), as well known in the art. A lower exhaust pipe (not shown) extends from the water lock to a discharge point, preferably such that the exhaust is discharged from the craft 20 into the body of water in which the craft is operating.

Preferably, the engine 22 is provided with a means for sensing the position of the throttle valve(s) 90. Preferably, this means comprises a throttle valve position sensor 110. The sensor 110 is arranged to provide throttle valve opening position data to an engine control, such as the ECU. This position data can be used to control the volume of fuel supplied to the engine 22 and the like. The sensor 110 may be of a variety of types known in the art. In the embodiment illustrated, the sensor 110 is arranged to provide throttle position data based upon a rotational position or angle of the throttle control shaft 92 associated with one of the valves 90.

In accordance with the present invention, the sensor 110 is preferably mounted in a manner which generally protects the sensor 110 from exposure to high heat, whereby the life of the sensor 110 in good operating condition is extended.

As illustrated, the sensor 110 is mounted at an end of the shaft 92 to which one of the throttle valves 90 are mounted. The sensor 110 is mounted at the end of the shaft 92 which extends beyond the throttle body 88 towards the bottom 46 of the lower portion 30 of the hull 26, as best illustrated in FIG. 1. The sensor 110 is preferably mounted to the shaft 92 corresponding to the valve 90 of the throttle body 88 which is closest the rear of the watercraft 20, and thus at the end of the shaft 92 which is opposite the cable 94 connection.

In this arrangement, the sensor 110 is positioned on the opposite or bottom side of the throttle body 88 from the exhaust manifold 114 (including the expansion portion 116 which is positioned adjacent the throttle body 88) and the remainder of the engine 22. In this manner, the throttle body 88 shields the sensor 110 from the heat which is radiated therefrom. In addition, the sensor 110 is positioned in a generally open area below the engine 22 where air may flow for cooling the sensor 110.

In the embodiment illustrated, the sensor 110 is preferably mounted in a protective housing or cover so that water which may splash about in the bottom of the hull 26 does not damage the sensor 110. In fact, this water may also serve to cool the sensor 110. Similarly, the fuel injector 102 and adjacent components are protected from this water with the cover 106.

Of course, the foregoing description is that of preferred embodiments of the invention, and various changes and modifications may be made without departing from the spirit and scope of the invention, as defined by the appended claims.

What is claimed is:

1. A watercraft having a water propulsion device and a hull defining an engine compartment, an internal combustion engine positioned in said engine compartment and having an output shaft arranged to power said water propulsion device, said engine having a body defining at least one combustion chamber and an intake system through which air is routed to said combustion chamber, said intake system including an intake pipe extending from said engine, a throttle valve movably positioned in said intake pipe for controlling the rate of air flow therethrough, and means for sensing a position of said throttle valve, said means for sensing positioned on a side of said intake pipe opposite said engine, whereby said means for sensing is shielded from heat radiated by said engine.

2. The watercraft in accordance with claim 1, wherein said engine is tilted so that a first side faces outwardly and upwardly and said intake pipe extends from said first side of said engine.

3. The watercraft in accordance with claim 1, wherein said engine includes an exhaust system for routing exhaust from said at least one combustion chamber, said exhaust system including an exhaust pipe extending between said body of said engine and said intake pipe.

4. The watercraft in accordance with claim 3, wherein said means for sensing is mounted on a side of said intake pipe generally opposite said exhaust pipe.

5. The watercraft in accordance with claim 1, wherein said throttle valve is connected to a control shaft, said shaft having an end extending beyond said intake pipe, and wherein said means for sensing comprises a sensor connected to said end of said shaft.

6. The watercraft in accordance with claim 5, wherein said end of said shaft extends towards a bottom of said hull of said watercraft.

7. A watercraft having a water propulsion device and a hull defining an engine compartment, an internal combustion engine positioned in said engine compartment and having an output shaft arranged to power said water propulsion device, said engine having a body defining at least one cylinder, said engine arranged so that said cylinder is tilted into a plane which is offset from vertical towards a first side of said engine, and an intake system through which air is routed to said combustion chamber, said intake system including an intake pipe extending from a second side of said engine opposite said first side, a throttle valve movably positioned in said intake pipe for controlling the rate of air flow therethrough, and a sensor for sensing a position of said throttle valve, said intake pipe having a top side which generally faces said engine and a bottom side which faces away from said engine towards a bottom of said hull, and wherein said sensor is positioned at said bottom side of said intake pipe.

8. The watercraft in accordance with claim 7, wherein an exhaust pipe extends from said first side of said engine and between said body of said engine and said intake pipe.

9. The watercraft in accordance with claim 7, wherein said intake pipe comprises a throttle body.

10. The watercraft in accordance with claim 7, wherein said throttle valve is connected to a control shaft, said shaft having an end extending below said bottom side of said intake pipe, and wherein said sensor is connected to said end of said shaft.

* * * * *